United States Patent [19]

Kambe et al.

[11] Patent Number: 4,475,866

[45] Date of Patent: Oct. 9, 1984

[54] LIQUID METAL MECHANICAL PUMP

[75] Inventors: Mitsuru Kambe, Higashi; Tomihiro Fukada, Nagareyama, both of Japan

[73] Assignee: Doryokuro Kakunenryo Kaihatsu Jigyodan, Tokyo, Japan

[21] Appl. No.: 370,545

[22] Filed: Apr. 21, 1982

[30] Foreign Application Priority Data

Apr. 30, 1981 [JP] Japan ..... 56-65422

[51] Int. Cl.[3] ..... F01D 25/14

[52] U.S. Cl. ..... 415/112; 415/170 R

[58] Field of Search ..... 415/110, 111, 112, 176, 415/178, 108

[56] References Cited

U.S. PATENT DOCUMENTS

| | | | |
|---|---|---|---|
| 1,472,560 | 10/1923 | Griffiths et al. | 415/183 X |
| 2,468,704 | 4/1949 | Pippin | 415/112 |
| 3,130,878 | 4/1964 | Zimmermann | 415/108 X |
| 3,431,860 | 3/1969 | Atz | 415/112 |
| 3,850,550 | 11/1974 | Kaessen | 415/111 X |
| 3,871,789 | 3/1975 | Lomeris | 415/111 X |
| 3,910,714 | 10/1975 | Allen et al. | 415/111 X |
| 3,947,154 | 3/1976 | Klepp et al. | 415/112 X |
| 4,190,396 | 2/1980 | Tomioka et al. | 415/110 |

*Primary Examiner*—Philip R. Coe
*Assistant Examiner*—Frankie L. Stinson
*Attorney, Agent, or Firm*—Wenderoth, Lind & Ponack

[57] ABSTRACT

An improvement in a liquid metal mechanical pump which includes a hydrostatic bearing immersed in liquid to rotatably support the lower end of a pump drive shaft and is constructed such that a part of liquid forced out of a diffuser is supplied to the bearing to lubricate it by the liquid. A cylindrical partition wall is disposed around the bearing with a clearance therebetween. The areas inside and outside the partition wall are communicated at a position remote from the diffuser. The partition wall prevents the liquid discharged from the diffuser from being directly supplied to the bearing, thereby reducing thermal shocks to the bearing.

4 Claims, 4 Drawing Figures

LIQUID METAL MECHANICAL PUMP

BACKGROUND OF THE INVENTION

This invention relates to a liquid metal mechanical pump having a hydrostatic bearing immersed in liquid, and more specifically to an improved liquid metal mechanical pump to reduce thermal shocks to a bearing of the pump by providing a partition wall around the bearing.

The most common design of a mechanical pump for liquid metal is a vertical, free liquid level type centrifugal pump which has a liquid metal contained in a casing and a cover gas sealed over the liquid level. This type of mechanical pump employs a hydrostatic bearing immersed in the liquid to rotatably support the lower end of a drive shaft of the pump and is constructed such that a part of the liquid forced out of a diffuser is supplied by the delivery pressure of the pump to the hydrostatic bearing to lubricate it by the liquid metal itself. In a conventional prior art pump of this type, one example of which is shown in FIG. 1, the liquid coming out of the diffuser 14 is directly supplied to the hydrostatic bearing 20. (Common reference numerals are assigned to the component parts of FIG. 1 that are identical to those of the embodiments of the present invention hereinafter described, and their construction and action will become apparent during the course of the following explanations.)

Thus, when operated under a thermal transient condition, the hydrostatic bearing 20 is subjected to the thermal shocks bringing about deterioration of the mechanical strength of the bearing material and making it difficult to maintain the function of the bearing due to the fact that the clearance between a bearing sleeve 5 and a bearing bush 6 is usually 0.4 to 0.5 mm. With the conventional pumps these problems still remain to be solved. To describe in more detail, the main loop pump for a liquid metal-cooled fast breeder reactor is subject to various thermal transient conditions in the event of fault or when the normal operating condition has been changed. Especially with the primary loop pump installed in the hot leg arrangement of the reactor, it is reported that the cold shock which the pump would undergo under the scram thermal transient condition has a temperature gradient of 3° C./sec, a temperature variation range of 150° C. and an expected frequency of 500 times (during the design life of 30 years). It should also be noted that the rated operating temperature is more than 500° C. It is therefore understood that reduction in thermal shocks to the bearing and in creep constitutes the major consideration in manufacturing the hot leg pump. On the other hand, the primary loop pump of cold leg arrangement also has problems such as the cold shock to the bearing at the time of the scram thermal transient condition and the hot shock caused when the secondary loop pump is tripped.

SUMMARY OF THE INVENTION

An object of this invention is to improve the safety and reliability and extend the lifetime of a mechanical pump for liquid metal by reducing thermal shocks to a liquid-immersed hydrostatic bearing of the pump, to thereby maintain the bearing function and alleviate the creep of the bearing material.

Reduction in thermal shock may be accomplished by first introducing a part of liquid metal, that is to be supplied to the bearing, into a mixing chamber provided around the liquid-immersed hydrostatic bearing to mix the liquid metal with existing liquid metal stored in the mixing chamber, and then supplying the mixed liquid metal to the bearing. By such mixing, it is possible to smooth out the temperature difference of liquid metal. However, simply providing the mixing chamber around the liquid-immersed hydrostatic bearing is not enough to effectively smooth out the temperature difference. To make possible the thorough smoothing out of the temperature difference, this invention provides a partition wall of particular shape within the mixing chamber.

Namely, this invention provides an improvement in a conventional liquid metal mechanical pump having a substantially cylindrical casing, a pump drive shaft vertically extending along the center of said casing, a hydrostatic bearing immersed in liquid rotatably supporting the lower portion of said drive shaft, a diffuser disposed below said bearing and including therein an impeller fixed to the lower end of said drive shaft, a suction nozzle provided at the bottom of said casing and connected to a suction pipe of said diffuser, and a delivery nozzle provided at the side wall of said casing and opposed to a delivery opening of said diffuser.

The improvement according to this invention comprises a cylindrical partition wall extending upwardly from the diffuser and surrounding the bearing along the axial direction thereof with a clearance between the partition wall and the bearing. The partition wall is provided with a communication portion between the areas inside and outside the partition wall at a position remote from the diffuser. The areas inside and outside the partition wall constitute a mixing chamber. By providing the partition wall in the mixing chamber, a part of liquid metal forced out of the diffuser is thoroughly mixed in the mixing chamber to thereby smooth out the temperature difference of liquid metal before being supplied to the hydrostatic bearing.

It should be noted that the smoothing out of the temperature difference becomes more effective as the volume of the mixing chamber is increased.

BRIEF DESCRIPTION OF THE DRAWINGS

In the drawings, in which like reference numerals denote like component parts.

DETAILED DESCRIPTION OF PREFERRED EMBODIMENTS

Figure 1:
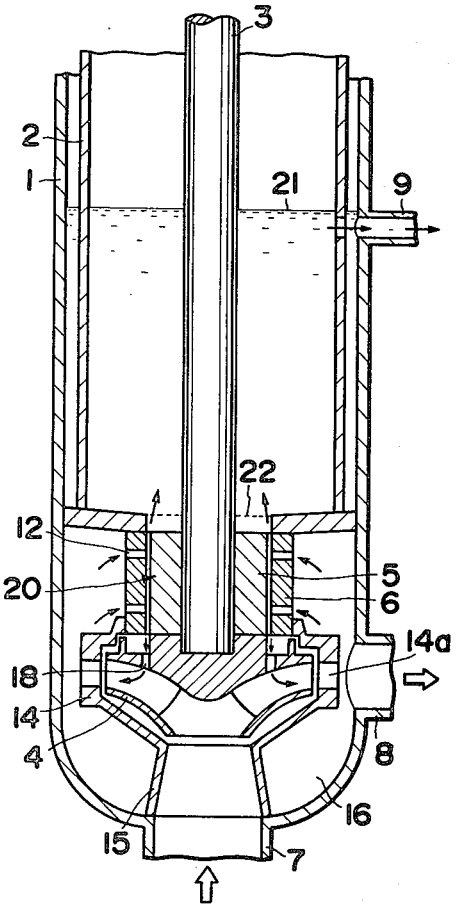
FIG. 1 PRIOR ART
FIG. 1 is a vertical sectional view showing a conventional mechanical pump for liquid metal.
Figure 2:
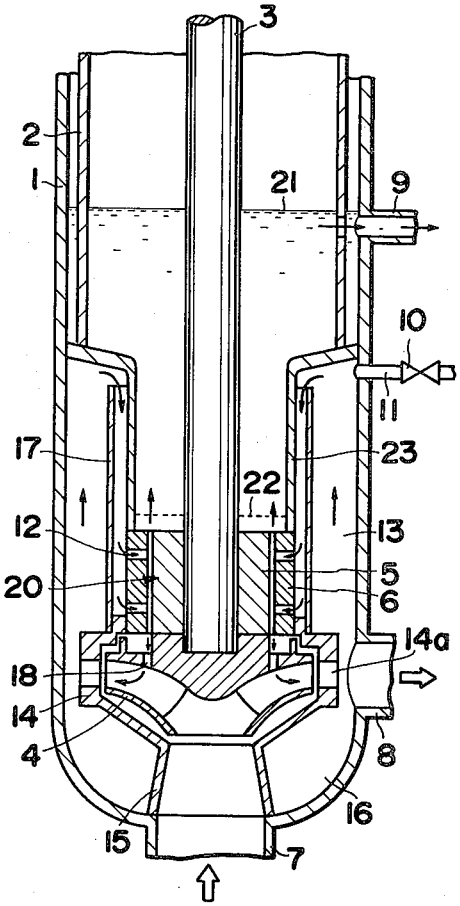
FIG. 2 is a vertical sectional view showing one embodiment of the present invention.

Referring to FIG. 2, there is shown one embodiment of this invention which, for better understanding of this invention, is applied to a vertical type, free liquid level centrifugal pump of the same basic construction as the conventional one. Thus, the function of this liquid metal mechanical pump itself is basically similar to that shown in FIG. 1. The pump consists mainly of an inner casing 2 disposed inside the outer casing 1, a drive shaft 3 vertically extending along the center of the inner casting 2, an impeller 4 fixed to the lower end of the drive shaft 3, and a liquid-immersed hydrostatic bearing 20 rotatably supporting the lower portion of the drive shaft 3. The outer casing 1 is substantially cylindrical and has a suction nozzle 7 at the bottom, a delivery nozzle 8 at the lower side and an overflow nozzle 9 at the upper side. Unlike the conventional one, this outer casing 1 is provided with a gas vent pipe 11 with a valve 10 at the center on its side (i.e. at a position corresponding to the upper end portion of a mixing chamber hereinbelow described.) Though it is sufficient to provide only one set of these nozzles and pipe, two or more sets may be provided, if necessary.

The hydrostatic bearing 20 includes a bearing sleeve 5 fixed to the lower portion of the drive shaft 3 and a cylindrical bearing bush 6 which is fitted over the bearing sleeve 5 with a small radial clearance (usually about 0.4 to 0.5 mm) therebetween and which has a plurality of radially extending holes 12.

From the upper end of the bearing bush 6 rises a cylinder 23 of substantially the same diameter as the external diameter of the bearing bush 6 with its upper end expanding radially outwardly to connect with the inner casing 2. At the upper edge surface of the radially expanding portion, the riser cylinder 23 is in contact with the outer casing 1. A space defined by the bearing bush 6, the riser cylinder 23 and the outer casing 1 is a mixing chamber 13. Below the bearing bush 6 is disposed a diffuser 14 under which a suction pipe 15 connected to the suction nozzle 7 is provided to separate a suction flow and a high pressure plenum 16. The delivery 14 has a delivery opening 14*a* which is opposed to the dilivery nozzle 8. The mixing chamber 13 has a large volume and is divided into two, inner and outer, areas or regions by a cylindrical partition wall 17. These regions are communicated at the position remote from the diffuser 14, i.e. at the position near the upper end of the partition wall 17. The main feature of this invention resides in the provision of such partition wall 17 and in the constructions therearound. Though not shown in the drawings, a mechanical bearing, a motor, and the like are conventionally mounted to the upper portion of the drive shaft 3 which is driven by the motor.

As the drive shaft 3 rotates, the liquid is taken into the pump through the suction nozzle 7, pressurized by the impeller 4 and then discharged through the delivery opening 14*a* of the diffuser 14 into the high pressure plenum 16. A large portion of the liquid in the high pressure plenum 16 is discharged through the delivery nozzle 8. The remaining liquid or a few percent of the liquid in the plenum 16 is supplied to the hydrostatic bearing 20 through the mixing chamber 13 located in the upper portion of the high pressure plenum 16. As described before, the mixing chamber 13 has the cylindrical partition wall 17. The partition wall 17 prevents the liquid discharged from the diffuser 14 from directly going to the hydrostatic bearing 20. Since the liquid coming out of the diffuser 14 is swirling to some degree, the liquid is sufficiently mixed in the large-volume mixing chamber 13 before entering the inside of the partition wall 17 and flowing into the holes 12 formed in the bearing bush 6. The liquid has a pressure equal to the delivery pressure of the pump and, when passing through the clearance between the bearing bush 6 and the bearing sleeve 5, lubricates both. A part of the liquid that has passed through the clearance enters the inner casing 2 to form a free liquid level 21 and flows out from the overflow nozzle 9. The remaining part of the liquid returns to the impeller through the return holes 18 provided below the bearing 20. As described above, since the partition wall 17 is provided according to this invention to prevent the liquid discharged from the diffuser 14 from directly flowing toward the hydrostatic bearing 20 and to assure thorough mixing of the liquid, a thermal shock to the hydrostatic bearing 20 that would be caused if the pump was operated under a thermal transient condition will be alleviated.

As in the conventional pump, it is of course required also in the liquid metal mechanical pump of this invention that the hydrostatic bearing 20 be submerged in the liquid during operation. Therefore, before starting operation of the pump, the valve 10 installed in the gas vent pipe 11 is opened to charge the liquid into the outer casing 1. (During the operation this valve 10 is kept closed.) Once the liquid metal is charged into the outer casing 1 in this way, the mixing chamber 13 will remain filled with the liquid even when the liquid level in the inner casing 2 reduces to the lowest level 22 at which the pump can still be operated, and therefore the supply of the liquid to the hydrostatic bearing 20 is always assured. In emptying the outer casing 1 of the liquid, the valve 10 has only to be opened.

Like the conventional pump, it is possible with the pump of this invention to draw the internal structure out of the outer casing 1. Therefore, the in-service inspection can be done with ease.

The material of the component parts of this invention is preferably stainless steel because of its compatibility with the liquid metal. But for the sliding surfaces of the bearing sleeve 5 and bearing bush 6, it is preferable to use Stellite to improve the resistance to wear. The partition wall 17 is always in contact with the liquid metal, so that it is desirable to construct the partition wall with material which is excellent in compatibility with the liquid metal and in durability and heat insulation. For example, it is preferable that the partition wall be constructed in multi-layers of stainless steel or that vacuum heat insulating layers be formed within the partition wall 17.

Figure 3:
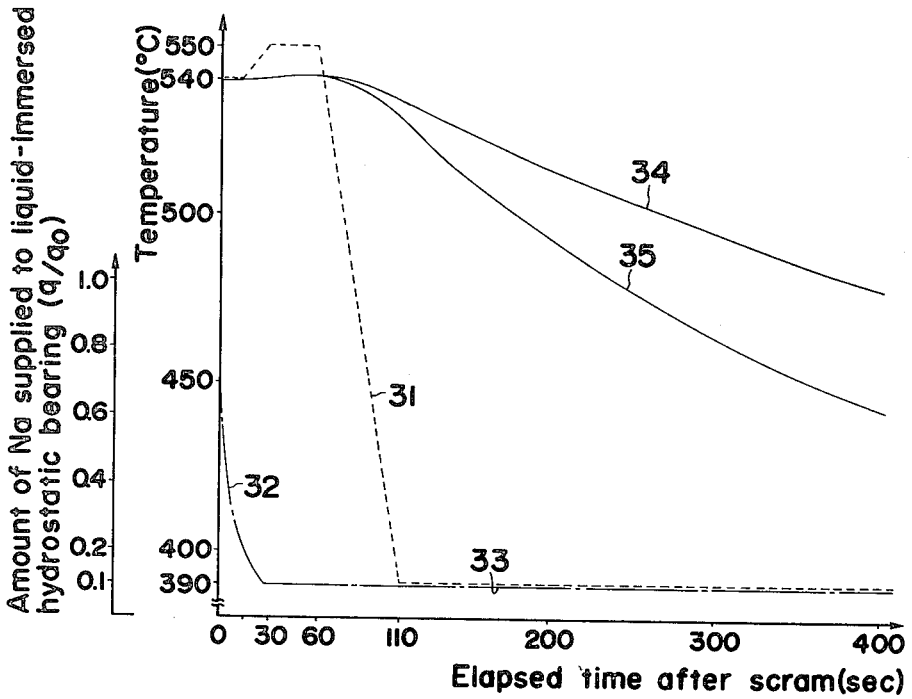
FIG. 3 is a graph showing the effect of this invention under the transient thermal condition of reactor scram.

FIG. 3 illustrates the calculated effect of this invention under the transient thermal condition of reactor scram when this invention is applied to the primary loop pump installed in the hot leg arrangement of a sodium-cooled fast breeder reactor. In the graph shown in FIG. 3, the abscissa represents the time that has elapsed in seconds after the scram and the ordinate represents the amount of sodium supplied to the hydrostatic where bearing $q/q_O$: is a nondimensional ratio and the temperature in degrees Centigrade. The symbols in FIG. 3 have the following definitions:

- q: the amount of sodium supplied to the hydrostatic bearing 20,
- $q_O$: the value of q when the pump is in rated operation, and
- V : effective volume of the mixing chamber 13.

In the graph shown in FIG. 3, the broken line 31 indicates the variation of temperature at the outlet of the reactor core, which temperature is assumed to drop from 550° C. to 390° C. at the gradient of 3.2° C./second. The one-dot line (32 and 33) represents the amount of sodium supplied to the hydrostatic bearing 20, which amount is assumed to be proportional to the amount of sodium delivery by the pump. That is, assuming that the pump is tripped at the same time as the scram, the variation of the value $q/q_O$ immediately after the scram is shown by a part 32 of the one-dot line. Further, a part 33 of the one-dot line 33 indicates the value of $q/q_O$ 30 seconds after the scram when the rotating speed of the pump reduces to 10% of the rated speed and when the pump operation is changed to the operation using a pony motor. Two solid curves 34, 35 show the temperature variation of the sodium supplied to the hydrostatic bearing 20 under the above conditions. It is, however, assumed in the calculation that the sodium is thoroughly mixed in the mixing chamber 13 and the partition wall 17 can completely insulate the heat of the sodium on each side thereof. The solid line 34 represents the case of $q_O/V=1/600$ ($sec^{-1}$) and the solid line 35 the case of $q_O/V=1/300$ ($sec^{-1}$). From this graph, it can be understood that, at the point 400 seconds after the scram, the temperature according to the line 34 drops only to 479° C. and according to the line 35 drops only to 443° C. This means that the construction as proposed by this invention can greatly reduce thermal shocks to the hydrostatic bearing 20.

Figure 4:
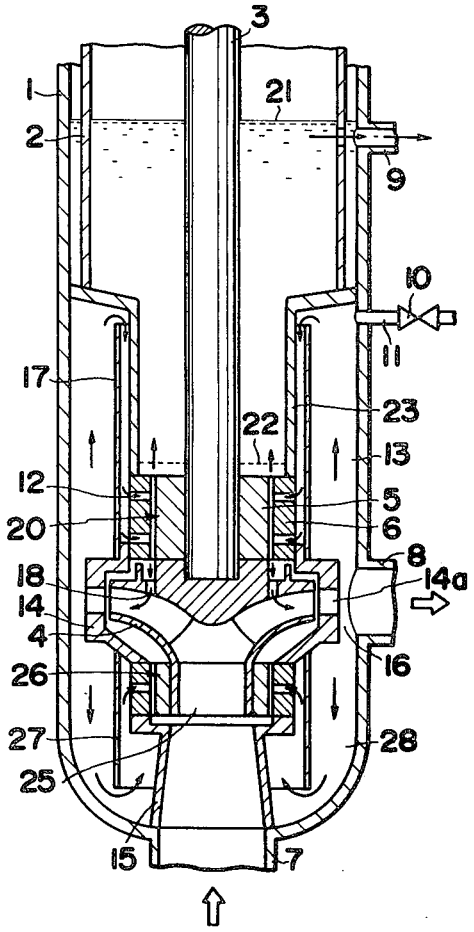
FIG. 4 is a vertical sectional view showing another embodiment of this invention.

Although only one embodiment of this invention has been described in the foregoing discussion, this invention is not limited to the construction of the above embodiment. FIG. 4 shows another embodiment of this invention which is applied to a single stage suction mechanical pump with an inducer. Designated 25 is an inducer where a second hydrostatic bearing 26 is provided. Fitted over the hydrostatic bearing 26 is a second cylindrical partition wall 27, the areas outside and inside of which constitute a second mixing chamber 28 where the liquid coming out of the diffuser 14 is thoroughly mixed and enters the inside of the second partition wall 27, thereby greatly reducing the thermal shock. The structure of other component parts is similar to that shown in FIG. 2, so identical components to those in FIG. 2 are given the common reference numerals and explanation of them is omitted here.

The above embodiments are of a single stage suction type, but the hydrostatic bearing 20 is often provided also in a two stage suction type mechanical pump. Therefore, also in the two stage suction type mechanical pump, this invention can be embodied in a manner similar to that shown in FIG. 4.

Having the construction as described above, this invention greatly reduces the thermal shock to the hydrostatic bearing 20 of the liquid metal mechanical pump. It is thus possible to eliminate the problem of maintaining the bearing function that would be hampered when subjected to thermal shock and the problem of alleviating the creep of the bearing material. This in turn produces various features, such as improvement of safety and reliability and longer life of the pump.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a liquid metal mechanical pump having a substantially cylindrical casing, a pump drive shaft vertically extending along the center of said casing, a hydrostatic bearing immersed in liquid metal rotatably supporting a lower portion of said drive shaft, and a diffuser disposed below said bearing, the improvement which comprises:

a solid, imperforate partition wall extending upwardly from said diffuser and surrounding said bearing along the axial direction thereof with a clearance between said solid partition wall and said bearing, said solid partition wall being provided with an upper end positioned substantially above the hydrostatic bearing between areas inside and outside said solid partition wall at a position remote from said diffuser, said area outside the solid partition wall constituting a mixing chamber, whereby a part of liquid metal forced out of the diffuser is thoroughly mixed in said mixing chamber in order to eliminate any temperature differences in said liquid metal and then the mixed part of the liquid metal flows over the upper end of the solid partition wall before being supplied to said hydrostatic bearing so that thermal shocks to the hydrostatic bearing are reduced.

2. The liquid metal mechanical pump according to claim 1, wherein said solid partition wall is longer in axial length than that of said hydrostatic bearing, thereby increasing the volume of said mixing chamber.

3. The liquid metal mechanical pump according to claim 1, wherein a gas vent pipe with a valve is provided below a free liquid metal level at a side wall of the casing in a position corresponding to the upper end portion of said mixing chamber.

4. The liquid metal mechanical pump according to claim 1, wherein the improvement further comprises:

a second hydrostatic bearing immersed in liquid metal and provided below said diffuser, and a second solid imperforate partition wall extending downwardly from said diffuser and surrounding said second hydrostatic bearing along the axial direction thereof with a clearance between said second solid partition wall and said second hydrostatic bearing, said second solid partition wall being provided with a lower end positioned substantially below the second hydrostatic bearing between areas inside and outside the second solid partition wall at a position remote from said diffuser, said area outside the second solid partition wall constituting a second mixing chamber.

* * * * *